US005927942A

United States Patent [19]

Stahl et al.

[11] Patent Number: 5,927,942

[45] Date of Patent: Jul. 27, 1999

[54] MOUNTING AND SEALING ARRANGEMENT FOR A TURBINE SHROUD SEGMENT

[75] Inventors: Matthew Stahl, College Station, Tex.; Daniel E. Kane; James R. Murdock, both of Tolland, Conn.; Donald E. Haddad, Amston, Conn.

[73] Assignee: United Technologies Corporation, Hartford, Conn.

[21] Appl. No.: 08/144,087

[22] Filed: Oct. 27, 1993

[51] Int. Cl.[6] ..... F01D 11/08

[52] U.S. Cl. ..... 415/115; 415/116

[58] Field of Search ..... 415/115, 116

[56] References Cited

U.S. PATENT DOCUMENTS

| | | | |
|---|---|---|---|
| 3,365,172 | 1/1968 | McDonough et al. | 253/39.15 |
| 3,583,824 | 6/1971 | Smuland et al. | 415/117 |
| 3,728,039 | 4/1973 | Plemmons et al. | 415/115 |
| 3,730,640 | 5/1973 | Rice et al. | 415/117 |
| 3,966,356 | 6/1976 | Irwin | 415/217 |
| 4,013,376 | 3/1977 | Bisson et al. | 415/117 |
| 4,053,254 | 10/1977 | Chaplin et al. | 415/116 |
| 4,311,432 | 1/1982 | Kildea | 415/134 |
| 4,573,865 | 3/1986 | Hsia et al. | 415/115 |
| 4,752,184 | 6/1988 | Liang | 415/116 |
| 4,992,025 | 2/1991 | Stroud et al. | 416/97 R |
| 5,088,888 | 2/1992 | Bobo | 415/170.1 |
| 5,165,847 | 11/1992 | Proctor et al. | 415/115 |
| 5,167,485 | 12/1992 | Starkweather | 415/115 |
| 5,167,487 | 12/1992 | Rock | 415/173.3 |
| 5,167,488 | 12/1992 | Ciokajlo et al. | 415/175 |
| 5,169,287 | 12/1992 | Proctor et al. | 415/115 |
| 5,188,506 | 2/1993 | Creevy et al. | 415/115 |

FOREIGN PATENT DOCUMENTS

| | | |
|---|---|---|
| 0545589 | 9/1993 | European Pat. Off. . |
| 2444801 | 12/1979 | France . |
| 2444802 | 12/1979 | France . |
| 2540937 | 8/1984 | France . |
| 153504 | 7/1987 | Japan . |
| 2119452 | 11/1983 | United Kingdom . |

*Primary Examiner*—John T. Kwon

[57] ABSTRACT

A shroud segment for a gas turbine engine includes a rail engaged with adjacent support structure to retain the segment and to provide sealing between the segment and the adjacent structure. Various construction details are disclosed which provide an effective sealing and retaining feature that permits differing thermal growth between the segment and the support structure. In a particular embodiment, a shroud segment includes a rail along a forward edge. The rail is engaged with a recess in the support structure to retain the segment and with a band which positions the segment and seals the forward edge.

4 Claims, 4 Drawing Sheets fig. 5
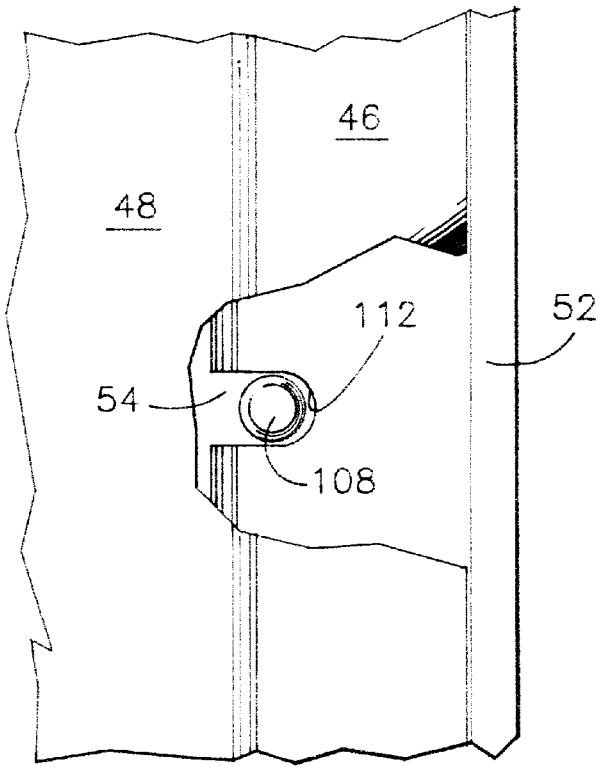
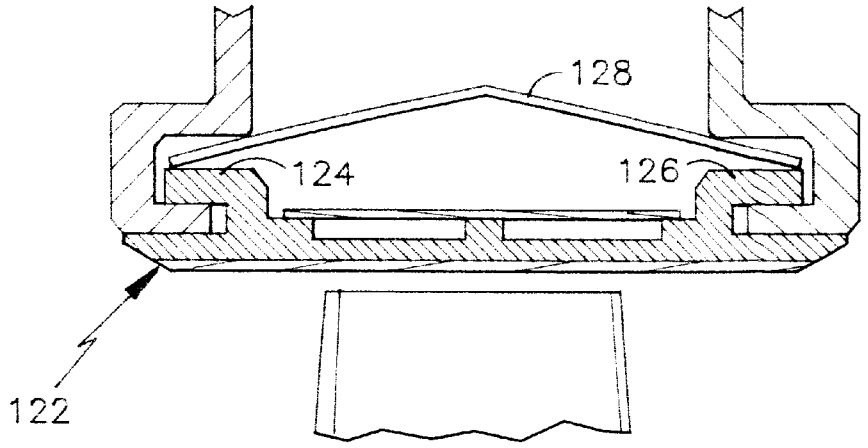
fig. 6

MOUNTING AND SEALING ARRANGEMENT FOR A TURBINE SHROUD SEGMENT

TECHNICAL FIELD

This invention relates to gas turbine engines, and more particularly to shroud segments for gas turbine engines.

BACKGROUND OF THE INVENTION

A conventional axial flow gas turbine engine includes an array of turbine blades which extend through a flow path for hot gases, or working fluid, exiting a combustion section. As a result of the engagement with the working fluid flowing through the flowpath, the array of blades rotate about a longitudinal axis of the gas turbine engine. Efficient operation of the turbine requires minimizing the amount of working fluid which bypasses the turbine blades as the working fluid flows through the turbine. One method of accomplishing this is to provide an annular shroud which extends about the array of turbine blades in close radial proximity to the radially outward tips of the turbine blades. Modern gas turbine engines typically use shrouds comprised of a plurality of segments which are circumferentially aligned to form the annular shroud.

Each shroud segment includes a substrate having means to retain the segment to the support structure of the turbine section and a flow surface facing the blade tips and exposed to the working fluid. In order to minimize the gaps between the flow surface and the blade tips, the flow surface may include an abradable coating. The abradable coating permits the blade tips to make contact with the segments during operation without damaging the blades. In effect, the blades and segments are tolerant of thermal growth during operation without significantly degrading efficiency.

Since the shroud segment is in contact with the hot gases of the working fluid, means to maintain the shroud segment within acceptable temperature limits is required. One means of cooling the segments is to flow some of the compressor fluid directly to the segments. This cooling fluid impinges upon the radially outer surface of the shroud segment and removes some heat from the segment. Another technique to minimize the temperature of the segment is to form the abradable layer from a ceramic material. The ceramic abradable coating provides insulation between the hot working fluid and the substrate. Further techniques include film cooling the abradable layer.

The means of retention is typically a hook type structure, either a plurality of individual hooks or a circumferentially extending rail, disposed on the upstream and downstream ends of the segment. The retention means engages with the support structure to radially retain the segment. The support structure may also include a pin which engages with an accommodating cut-out in the segment to position the segment laterally.

Sealing mechanisms are used to prevent cooling fluid from bypassing the segment and flowing between adjacent segments or between the segments and the support structure. Conventional sealing mechanisms for segments include feather seals and 'W' seals. Feather seals extend laterally between adjacent segments to seal this opening. 'W' seals are disposed between the segments and the support structure to seal this opening. 'W' seals usually require a laterally extending sealing surface on the seal segment to engage the 'W' seal. Due to the presence of this sealing surface along the axial edges, the hooks and rails extend further outward from the substrate and present a larger profile.

Shroud segments, since they are exposed to extreme temperatures and abrasive contact from the rotating blades, are replaced frequently. A large temperature gradient may exist between the radially outer surfaces of the substrate, exposed to cooling fluid, and the flow surface, which is exposed to the working fluid. The temperature gradient, and the thermal expansion that results from it, cause the segment to distort. This distortion may increase the destructive contact between the segment and the blade. Another problem occurs, however, if the segment is stiffened to prevent distortion, such as by having an extending rail rather than spaced hooks. In this case, compressive stresses may be induced in the substrate and the ceramic abradable layer as a result of the segment not being permitted to distort enough to accommodate the thermal deflection. This may lead to cracking of the substrate, the abradable layer, or both. A further concern is the size and weight of the segments.

One possible solution is to remove the 'W' seal and have short, circumferentially spaced hooks as the retaining means. This configuration, however, would provide insufficient sealing and require additional cooling fluid to be drawn from the compressor. Another solution is to have a continuous rail which fits snugly within the support structure to provide the needed sealing. This configuration, however, would not accommodate thermal growth of the segment and would result in thermal stress related damage to the segment or support structure. Having a loose fitting rail and accepting some cooling fluid loss would accommodate some thermal expansion, but would introduce a variation in the radial positioning of the segment. This variation would produce larger radial gaps between the blade and the shroud and result in less efficient engagement between the blades and the working fluid.

The above art notwithstanding, scientists and engineers under the direction of Applicants' Assignee are working to develop thin, flexible shroud segments which provide both effective sealing between the segment and the support structure and permit thermal growth of the segment under operation conditions.

DISCLOSURE OF THE INVENTION

According to the present invention, a shroud segment includes a rail wherein the rail is engaged with a resilient member to position the segment within the support structure, to permit thermal growth and distortion of the segment, and to block fluid flow between the segment and support structure.

According to a specific embodiment of the present invention, the rail engages the resilient member to provide a first sealing edge and engages a lip of the support structure to provide a second sealing edge. Engagement between the rail and the lip is encouraged by the interaction between the segment and the resilient member. Cooling fluid which escapes through the first sealing edge must pass through the second sealing edge in order to reach the working fluid flow path.

According to another specific embodiment, the first and second sealing edges are configured such that a labyrinth type sealing mechanism is provided. Fluid escaping through the first sealing edge flows in a first axial direction, fluid escaping through the second sealing edge flows in a second axial direction opposite that of the first axial direction, and fluid which escapes the second sealing edge is redirected back toward the first axial direction before passing to the working fluid flowpath.

According to a further specific embodiment, the engagement between the rail and the support structure defines a radial gap and an axial gap. The radial gap provides for radially directed thermal growth of the segment and the axial gap provides for axially directed thermal growth of the segment.

A principle feature of the present invention is the rail having both a retaining function and a sealing function. A feature of a particular embodiment is the multiple sealing edges. A feature of another particular embodiment is the labyrinth configuration of the multiple sealing edges and passages. A feature of a further particular embodiment is the radial and axial gaps between the segment and the support structure.

A primary advantage of the present invention is structural flexibility of the segment as a result of the low profile rail. Since the rail performs both the retaining function and the sealing function, further sealing mechanisms, such as 'W' seals, are not required and the size of the rail can be shorter in profile. Shortening the rail makes the rail, and thereby the segment, more flexible and more likely to bend or distort under thermal stress. Flexibility reduces the stresses in the abradable layer of the segment. An advantage of a particular embodiment is the effective sealing resulting from having multiple sealing edges and a labyrinth configuration. A further advantage of another particular embodiment is the minimal likelihood of binding between the segment and the support structure as a result of the provision of radial and axial gaps. Without the radial and axial gaps, binding could occur which may result in damage to the segment. The radial gap is possible because the segment is radially positioned by the interaction between the segment and the resilient member.

The foregoing and other objects, features and advantages of the present invention become more apparent in light of the following detailed description of the exemplary embodiments thereof, as illustrated in the accompanying drawings.

BRIEF DESCRIPTION OF THE DRAWINGS

FIG. 5 is a view taken along line 5—5 of FIG. 4, partially cut away to show the locating pin.

FIG. 6 is a side view of an alternate embodiment of a shroud segment engaged with turbine support structure and a band.

BEST MODE FOR CARRYING OUT THE INVENTION

Figure 1:
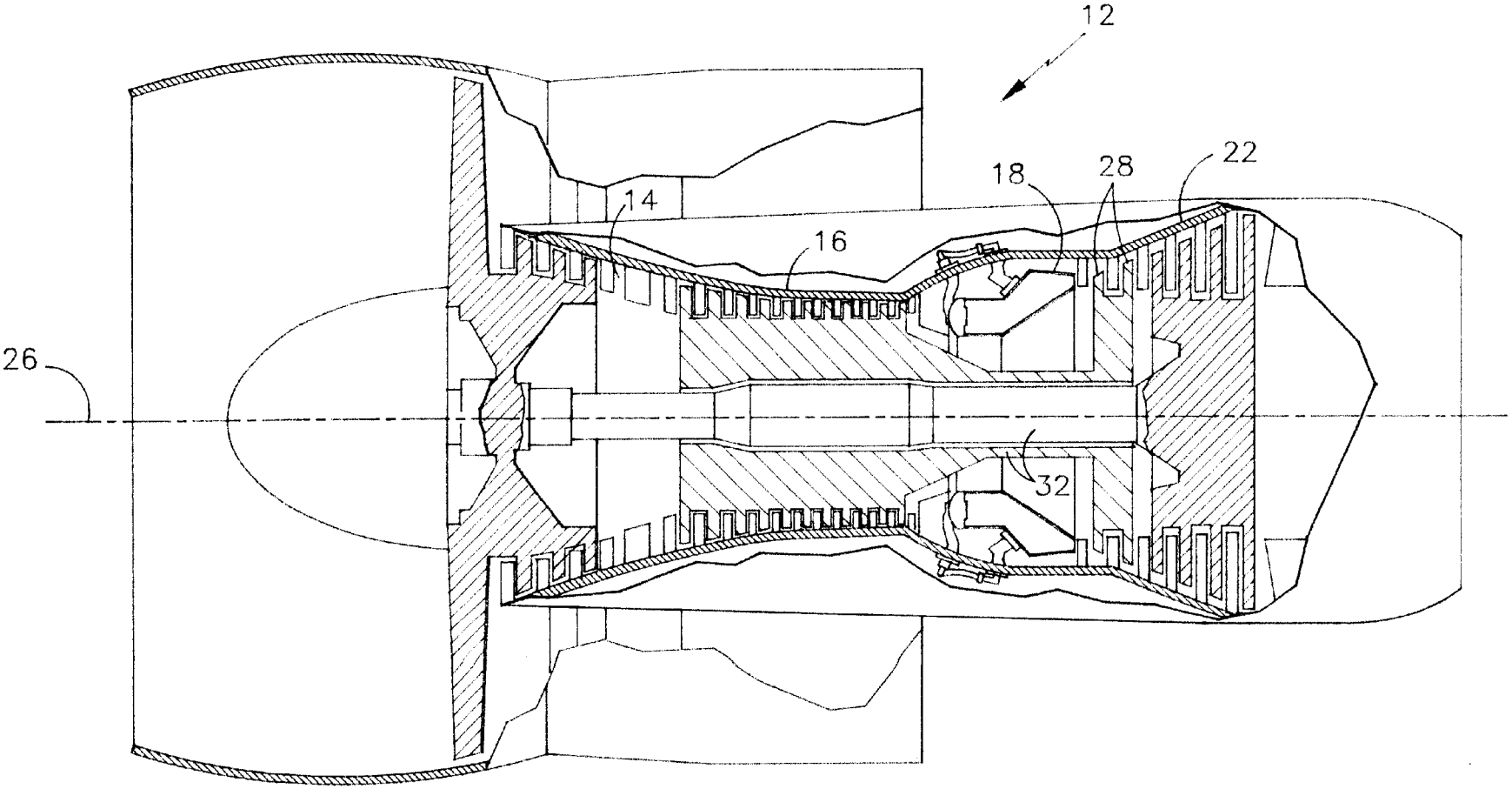
FIG. 1 is a side view of a gas turbine engine, partially cut away and sectioned to show a compressor section, a combustor, and a turbine section.

Referring now to FIG. 1, a gas turbine engine 12 includes a compressor section 16, a combustor 18, and a turbine section 22. The gas turbine engine 12 is disposed about a longitudinal axis 26 and includes an annular, axially oriented flowpath 14 which extends through the compressor section 16, combustor 18, and turbine section 22. Working fluid enters the compressor section 16 where work is performed upon the working fluid to add energy in the form of increased momentum. The working fluid exits the compressor section 16 and enters the combustor 18 wherein fuel is mixed with the working fluid. The mixture is ignited in the combustor 18 to further add energy to the working fluid. The combustion process results in raising the temperature of the working fluid exiting the combustor 18 and entering the turbine section 22. Within the turbine section 22, the working fluid engages a plurality of rotor assemblies 28 to transfer energy from the hot gases of the working fluid to the rotor assemblies 28. A portion of this transferred energy is then transmitted back to the compressor section 16 via a rotating shaft 32. The remainder of the transferred energy may be used for other functions.

Figure 2:
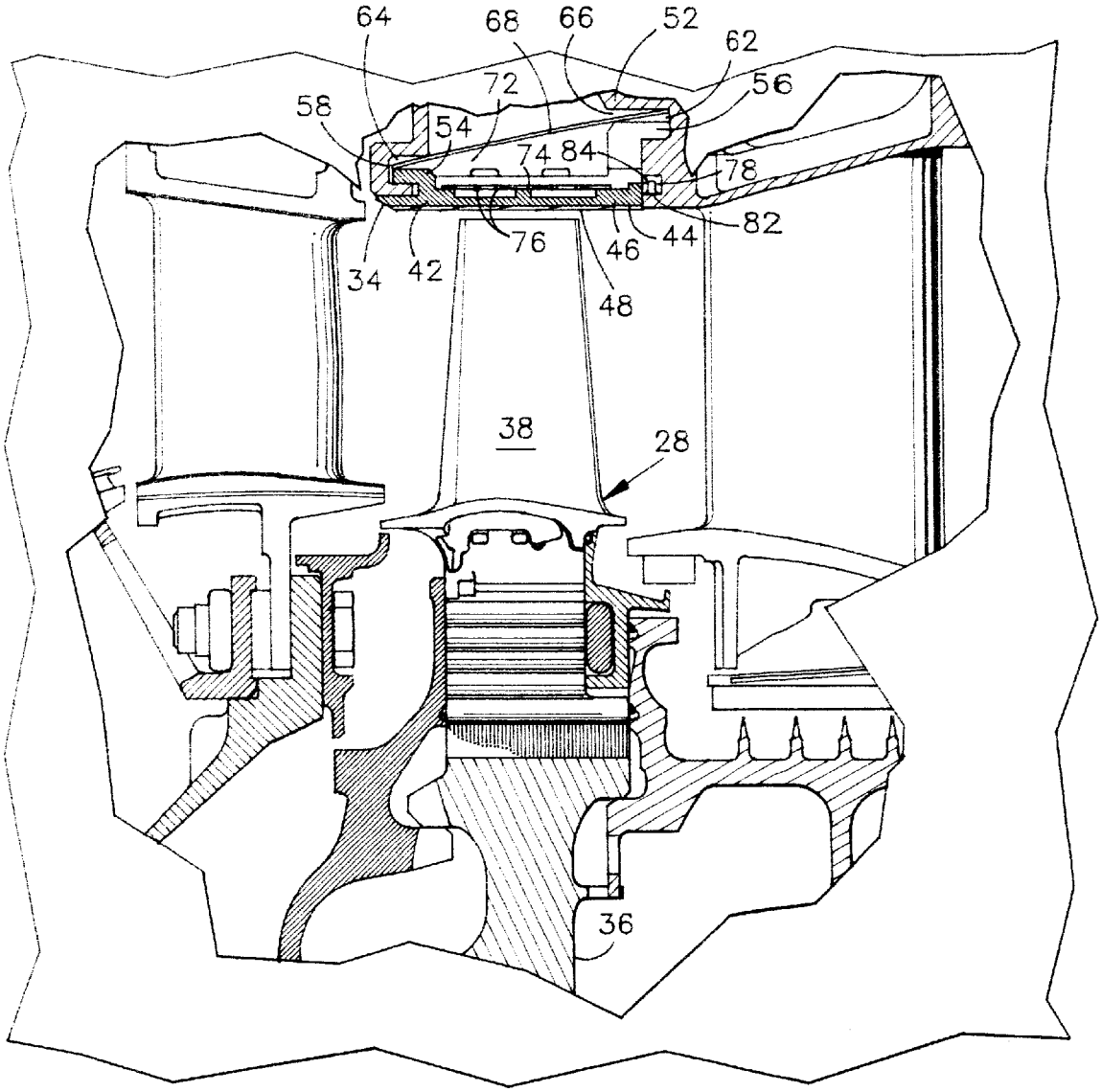
FIG. 2 is a side view of a first stage turbine rotor assembly and a turbine shroud.

Referring now to FIG. 2, the rotor assembly 28 and a turbine shroud 34 are illustrated. The rotor assembly includes a disk 36 and a plurality of rotor blades 38 disposed about the outer periphery of the disk 36. The turbine shroud 34 is disposed radially outward of the plurality of rotor blades 38. The turbine shroud 34 includes a plurality of circumferentially adjacent segments 42. The segments 42 form an annular ring having a flow surface 44 in radial proximity to the radially outer tips of the plurality of rotor blades 38.

Each segment 42 includes a substrate 46 and an abradable layer 48. Each segment 42 is engaged with adjacent turbine support structure 52 to radially and axially retain the segment 42 into proper position. The axially forward edge of the segment 42 includes a low profile rail 54 and the aft edge includes a plurality of hooks 56. Both the rail 54 and the hooks 56 are engaged with one of a pair of recesses 58,62 in the turbine structure 52 to provide radial retention of the segment 42. The radial width of both the rail 54 and each of the hooks 56 is substantially less than the radial width of the recess 58,62 with which it is engaged to form a pair of radial gaps 64,66. A segmented band 68 is disposed within both the forward gap 64 and the aft gap 66. The band 68 extends circumferentially over several segments 42 and engages both the turbine structure 52 and the segment 42 via the rail 54 and the aft hooks 56. The band 68 provides means to resiliently mount the segment 42 in the radial direction. The resilient feature of the band 68 permits thermal growth of the segment 42 during operation and accommodates differing thermal growth and distortion between the segment 42 and adjacent structure 52. Although shown as a band, this device may be any resilient member which provides a radially inward directed force to radially position the segment. Further, the band may be segmented such that each band extends over one or more segments, or may be a single piece extending about the plurality of segments.

Cooling fluid flows radially inward from passages (not shown) within the turbine structure 52, through openings in the band 68 and into a cavity 72 defined between the band and the radially outer surface 74 of the segment. The cooling fluid then flows through impingement holes 76 in the radially outer surface 74 and impinges upon the substrate 46. The cooling fluid maintains the segment 42 within acceptable temperature limits based upon material considerations.

Efficient utilization of the cooling fluid requires sealing around the edges of the segment 42. The gap between adjacent segments is typically sealed by a feather seal (not shown) in a conventional manner. The aft edge, as shown in FIG. 2, is sealed by a 'W' seal 78. The W seal 78 is positioned within a recess 82 in the turbine structure 52 and is engaged with an aft surface 84 of the segment 42. The aft surface 84 is radially inward of each of the aft hooks 56. The aft hooks 56 are larger than the rail in radial dimension in part to account for the presence of the 'W' seal 78 and aft surface 84.

Figure 3:
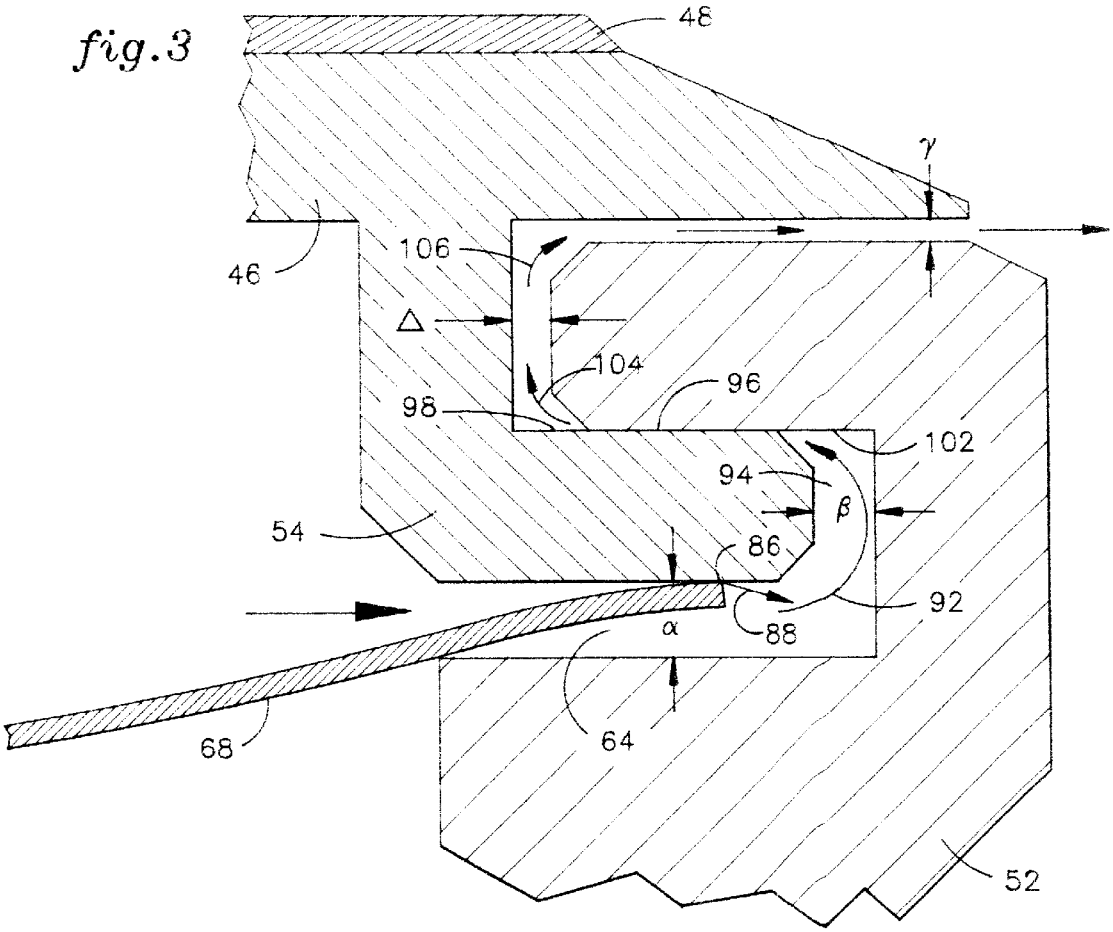
FIG. 3 is a sectional side view of the forward edge of a sealed segment engaged with the turbine casing and a band.

The forward edge of the segment 42 is sealed by the engagement between the low profile rail 54, the turbine structure 52, and the band 68. As shown more clearly in FIG. 3, the band 68 engages an outwardly facing surface of the rail 54. Engagement between the band 68 and the rail 54 provides a primary sealing edge 86 to block cooling fluid from escaping the radial cavity 72. Cooling fluid which escapes through the primary sealing edge 86, however, must flow first axially forward (see arrow 88) and then radially inward (see arrow 92) through the radial gap 64 between the rail 54 and the turbine structure 52 and through an axial gap 94. The cooling fluid which escapes the first sealing edge 86 then engages a secondary sealing edge 96 which is defined by the engagement between the radially inward facing surface 98 of the rail 54 and an adjacent surface 102 of the turbine structure 52. This secondary sealing edge 96 extends in the axial direction, which is also the direction of which cooling fluid which escapes through the secondary sealing edge must flow. If cooling fluid escapes through both the primary and secondary sealing edges 86,96, it is then turned radially inward (see arrow 104) and then finally turned again into an axially forward direction (see arrow 106). The combination of the primary sealing edge 86, the secondary sealing edge 96, and the labyrinth type configuration of the leakage paths provides means to seal the axially forward edge of the segment 42.

Figure 4:
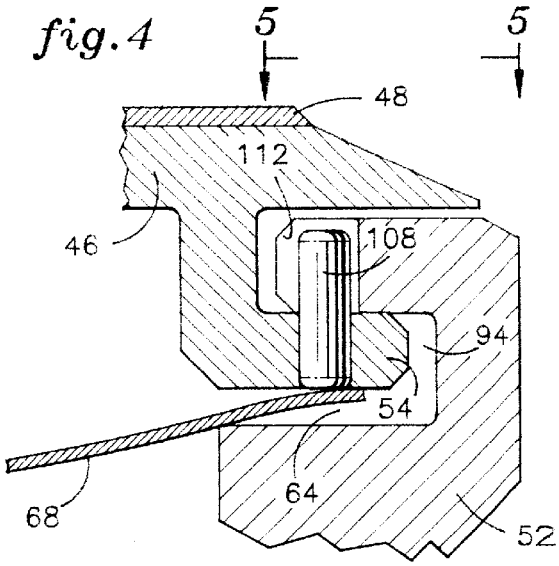
FIG. 4 is a side view of the forward edge of a shroud segment partially cut away to show a locating pin engaged with the turbine casing.

Referring now to FIGS. 4 and 5, each segment is circumferentially retained into position by a pin 108 which extends through the low profile rail 54. The pin 108 extends radially inward from the rail 54 and is engaged with a cutout 112 in the turbine structure 52. This configuration, rather than the conventional configuration of using a pin in the turbine structure engaged with a cutout in the segment, eliminates an additional leakage path associated with having cutouts in the segments.

During operation, the gases of the working fluid flow over the abradable surface 48 of the segment 42 and heat the segment 42. As the segment 42 heats, it thermally expands in the axial and radial directions. Axial expansion is accounted for by having gaps $\beta$ and $\Delta$ between the segment 42 and the turbine structure 52 along the forward edge. Radial expansion is accounted for by having gaps $\alpha$ and $\gamma$ between the forward edge and the turbine structure 52. In addition, the radial positioning of the segment 42 is maintained by the band 68 during the radial expansion of the segment. As the segment 42 heats up, the gaps reduce in size without degrading the sealing edges 86,96. In addition, the reduction in size of the gaps results in a reduction in the amount of cooling fluid which leaks around the forward edge. This reduction in leakage increases the cooling fluid which flows to the segment 42 and helps to maintain the segment 42 within acceptable temperature limits.

Although shown in FIGS. 1–5 as a shroud segment having a rail engaged with a band along only one edge, an alternate embodiment of a shroud segment 122 having a forward rail 124, aft rail 126, and a band 128 engaged with both rails 124,126 is shown in FIG. 6. In this embodiment, engagement between the band 128 and rails 124,126 provides retention and sealing of both the axially forward and aft edges in a manner similar to that described for the forward rail of the segment shown in FIGS. 1–5.

Although the invention has been shown and described with respect with exemplary embodiments thereof, it should be understood by those skilled in the art that various changes, omissions, and additions may be made thereto, without departing from the spirit and scope of the invention.

What is claimed is:

1. A shroud segment for a gas turbine engine, the gas turbine engine disposed about a longitudinal axis and including fluid passage defining a flow path for working fluid, a support structure, the support structure having, a pair of axially spaced recesses, and a circumferentially extending resilient member, and means to flow cooling fluid through the support structure, the segment having an installed condition wherein the segment is retained to the support structure, wherein the segment comprises:

a substrate having a flow surface and a radially outer surface, wherein in the installed condition the flow surface faces the flow passage and the radially outer surface is exposed to the flow of cooling fluid; and a rail disposed along one edge of the substrate, the rail including an inwardly facing surface and an outwardly facing surface, the rail in the installed condition being engaged with the support structure within the recess, the rail to retain the segment to the support structure and to block the flow of cooling fluid between the segment and the support structure; and a pin extending radially inwardly from the rail, the pin adapted to engage the support structure to circumferentially locate the segment relative to the support structure;

wherein, in the installed condition, the outwardly facing surface of the rail engages the resilient member such that the segment is urged radially inward and such that a primary sealing edge is produced which blocks cooling fluid leakage between the rail and resilient member; the inwardly facing surface of the rail engages an adjacent surface of the support structure such that a secondary sealing edge is produced which blocks cooling fluid which leaks through the primary sealing edge from leaking between the rail and the support structure.

2. The shroud segment according to claim 1, wherein the arrangement of sealing edges between the rail and the support structure defines a labyrinth seal wherein cooling fluid leaking through the primary sealing edge flows in a first axial direction towards the secondary sealing edge, cooling fluid leaking through the secondary sealing edge flows in a second axial direction opposite of the first axial direction and towards the opposing surface of the recess, and leakage air flowing between the opposing surface and the radially inner surface of the platform flows in the same axial direction as the first axial direction.

3. A shroud for a gas turbine engine, the gas turbine engine disposed about a longitudinal axis and including fluid passage defining a flow path for working fluid, a support structure, the support structure having a pair of axially spaced recesses, and a circumferentially extending resilient member, and means to flow cooling fluid through the support structure, the shroud including a plurality of circumferentially spaced shroud segments, wherein each segment comprises:

a substrate having a flow surface and a radially outer surface, wherein in the installed condition the flow surface faces the flow passage and the radially outer surface is exposed to the flow of cooling fluid;

a rail disposed along one edge of the substrate, the rail including an inwardly facing surface and an outwardly facing surface, the rail in the installed condition being engaged with the support structure within the recess, the rail to retain the segment to the support structure and to block the flow of cooling fluid between the segment and the support structure; and a pin extending radially inwardly from the rail, the pin adapted to engage the support structure to circumferentially locate the segment relative to the support structure;

wherein, in the installed condition, the outwardly facing surface of the rail engages the resilient member such that the segment is urged radially inward and such that a primary sealing edge is produced which blocks cooling fluid leakage between the rail and resilient member; the inwardly facing surface of the rail engages an adjacent surface of the support structure such that a secondary sealing edge is produced which blocks cooling fluid which leaks through the primary sealing edge from leaking between the rail and the support structure.

4. The shroud segment according to claim 3, wherein the arrangement of sealing edges between the rail and the support structure defines a labyrinth seal wherein cooling fluid leaking through the primary sealing edge flows in a first axial direction towards the secondary sealing edge, cooling fluid leaking through the secondary sealing edge flows in a second axial direction opposite of the first axial direction and towards the opposing surface of the recess, and leakage air flowing between the opposing surface and the radially inner surface of the platform flows in the same axial direction as the first axial direction.

* * * * *